United States Patent [19]

Lauchenauer

[11] 4,328,058

[45] May 4, 1982

[54] TACK SPUN MATERIALS

[75] Inventor: Alfred E. Lauchenauer, Horn, Switzerland

[73] Assignee: Raduner & Co. A.G., Horn, Switzerland

[21] Appl. No.: 163,116

[22] Filed: Jun. 26, 1980

Related U.S. Application Data

[60] Continuation of Ser. No. 44,887, Jun. 4, 1979, abandoned, which is a division of Ser. No. 875,030, Feb. 3, 1978, Pat. No. 4,235,946.

[30] Foreign Application Priority Data

Feb. 4, 1977 [GB] United Kingdom ..... 774779
Jan. 23, 1978 [GB] United Kingdom ..... 782594

[51] Int. Cl.[3] ..... B32B 31/18; B32B 5/02

[52] U.S. Cl. ..... 156/254; 156/344; 156/498; 264/164; 427/185; 428/85; 428/92

[58] Field of Search ..... 156/254, 344, 498; 264/164; 427/185; 428/85, 86, 90, 92, 95

[56] References Cited

U.S. PATENT DOCUMENTS 3,708,565 1/1973 Seiffert ..... 264/284 X
3,814,791 6/1974 Jones ..... 264/164
4,235,946 11/1980 Lauchenauer ..... 428/85 X

*Primary Examiner*—Edward C. Kimlin
*Assistant Examiner*—Robert A. Dawson
*Attorney, Agent, or Firm*—Edwin E. Greigg

[57] ABSTRACT

This invention is concerned with the tack spinning of materials and has particular reference to the formation of tack spun materials by applying a theromplastic polymer to a backing or carrier sheet to form a pattern or layer thereon and then heating the layer and contacting the layer with a second surface whereby separation of the carrier from the second surface results in separation of the thermoplastic polymer within its plane to draw fibres therefrom on progressive separation. The preferred embodiment of the invention involves two backing sheets prepared between a pair of nip rollers to form a sandwich structure with a layer of thermoplastic tack spinnable material and separating the same on the downstream side of the nip to provide the fibres disposed substantially transverse to the plane of the carrier sheet. The invention also describes novel apparatus for performing this operation.

8 Claims, 3 Drawing Figures

TACK SPUN MATERIALS

This is a Continuation of application Ser. No. 44,887 filed June 4, 1979 and now abandoned, which is in turn a division of application Ser. No. 875,030, filed Feb. 3, 1978 and now U.S. Pat. No. 4,235,946.

The present invention relates to tack spun materials and has particular reference to tack spun materials in the form of a fusible sheet for inter-linings and the like.

Tack spinning is generally well known and comprises a process whereby a sheet of thermoplastic material is heated to or near its melting point and is then separated along its plane, the two portions being drawn apart thus drawing fibres from the surface of each of the separated portions and thereafter directing a stream of coolant onto the fibres during formation to set the formed fibres thus providing a thermoplastic sheet having a fibrous surface on one side thereof.

According to the present invention there is provided a method of tack spinning which comprises applying a thermoplastic polymer to a backing to form a pattern or layer thereon, heating the layer by contact with a heating surface sufficient to render a surface of the layer tacky and separating the backing surface progressively from the heating surface to draw fibres of polymer therefrom and simultaneously directing a stream of coolant onto the fibres to set the same. In a particular embodiment of the present invention, the heating may be effected by a roller and the backing carrying the thermoplastic layer may be contacted with the roller to heat the exposed surface of the thermoplastic layer so that as the thermoplastic layer and backing carrying the same is separated from the roller, fibres are drawn from the surface of the layer to the roller. In a particular embodiment of the present invention, a molten thermoplastic material is formed at the nip between two rollers and the backing sheet feed about the surface of one of the rollers and through the melt of thermoplastic material to entrain a layer of thermoplastic from which fibres are drawn after the backing sheet layer has passed through the nip of the rollers.

The invention also includes a method of tack spinning which method comprises:

(a) laminating a pair of backing sheets by interposing a pattern or layer of thermoplastic material therebetween to bond the sheets together.

(b) applying heat to the laminate to render the layer of thermoplastic material tacky, and (c) progressively separating the backing sheets to draw the thermoplastic material into fibres and directing a stream of coolant onto the fibres during formation to set the same.

In a particular embodiment of the present invention there is provided a method for the formation of fusible sheet material by forming a laminate of two sheets of material by interposing a layer of thermoplastics polymeric material capable of being reversably rendered tacky, said thermoplastic material serving to bond the said sheets together, heating the sandwich structure so produced to an elevated temperature at which the bond strength between the sheets is decreased by at least 50% and then separating the two sheets while the polymer layer is maintained at that elevated temperature and applying a cooling agent to the fibrous filaments formed from the surface of the polymer layer adhering to each sheet after separation whereby the angle of separation, the degree of cooling and the rate of separation is selected such that the average solidifying length of fibrous structures formed by the thermoplastic polymer between the diverging sheet is substantially twice the average desired length of the fibrous structure of the individual sheet material. The temperature to which the sandwich structure is heated may be such that the said polymeric thermoplastic material loses virtually completely any structural stress features as discernible through a microscope in polarised light between crossed nicols.

The laminate may be separated immediately upon formation or may be cooled and then reheated.

The cooling of the laminate per se after formation may be sufficient to reduce the temperature of the thermoplastics material below its softening point or until the bond strength of the thermoplastic material is greater than 50% of the bond strength at ambient temperatures.

The separation angle, that is to say the angle formed by separating the sheet materials, the degree of cooling, and the separating speed are preferably selected such that the average solidifying length of the fibrous structures formed by the tackified thermoplastic material between the diverging sheets is substantially twice the average desired length of the fibrous structure on the individual sheet materials. The solidifying length may be the length that fibrous structures have reached between the diverging sheet materials when they have solidified to a point that they will show at least in some areas along their length, structural stress features discernable in polarised light between the cross nicols of a microscope and at which they have an elongation at break determined over their full length of not more than 25%.

A cooling agent is preferably applied to the roots of the fibrous structures formed in the tackified thermoplastic polymer between the separating sheets during separation.

The cooling agent may be a gas, such as cold air or may be a liquid or may be a particulate solid. In a particular embodiment of the present invention the cooling agent may be a particulate solid, typically activated carbon which is caused to adhere to the fibres thus providing an absorptive layer of considerably increased surface absorption area.

The thermoplastic material is preferably a material having a melting point of at least 50° C. and a melt index of 1 to 200 and preferably 10 to 50.

Typical materials are polyethylene having a melt index of the order of 6, polyamide terpolymers of nylon 6, nylon 66 and nylon 11 having a softening range of 123° C. to 128° C. and a melt index of the order of 21, polyester polymers, copolymers of ethylene and vinyl acetate.

The present invention also includes a tack spun product comprising a carrier sheet material and a layer pattern and/or coating of thermoplastic material on the surface of this said sheet material, and the exposed surface of said thermoplastic layer having a plurality of fibres extending therefrom transverse to the plane of the carrier sheet wherein the thermoplastic material has a melting point of at least 50° C. and a melt index of 1 to 200. The invention further includes tack spun product in accordance with the invention wherein the surface of the fibres themselves carry particles of activated carbon to provide an absorption material of high surface area.

The present invention further includes apparatus for the tack spinning of materials which apparatus comprises:

means for advancing a carrier sheet having a layer of thermoplastic material thereon, means for heating the surface of said thermoplastic material by contact with a heated surface sufficient to render the surface of said thermoplastic material tacky, means for separating said carrier sheet and said heated surface progressively while drawing fibres of polymer from the surface of said thermoplastic material and means for directing a stream of cooling agent onto the fibres to set the same. The means for advancing and heating may comprise a pair of rollers arranged to provide a nip therebetween through which the thermoplastic polymer and the carrier sheet are advanced and at least one of said rollers being heated to constitute the heating means.

The invention further includes apparatus for the tack spinning of materials which comprises a pair of rolls defining a nip, means for the supply of a carrier material to each roll to bring the carrier sheets together, means for the supply of a tack spinnable thermoplastic material to the nip to form a layer between said carrier sheets, means for heating said thermoplastic material at said nip, means for cooling said thermoplastic material to form a bond between said carrier sheets;

second heating means for reheating said thermoplastic material sufficient to render the thermoplastic material tacky, means for separating progressively the carrier sheets while the thermoplastic material is tacky to draw fibres from the surface of said thermoplastic material, and means for directing a stream of cooling agent onto the fibres to set the same.

The means for cooling the fibres may comprise an air stream directed onto the fibres. In an alternative embodiment the means for cooling may comprise a liquid coolant disposed within the nip of the rollers to effect cooling of the fibres during formation.

In an alternative embodiment of the present invention the coolant may be a fluidised bed of solid particles which are kept suspended by gas pressure so that the coolant comprises a particulate solids material and the gas per se.

Following is a description by way of example only and with reference to the accompanying informal drawings of a method of carrying the invention into effect.

Figure 1:
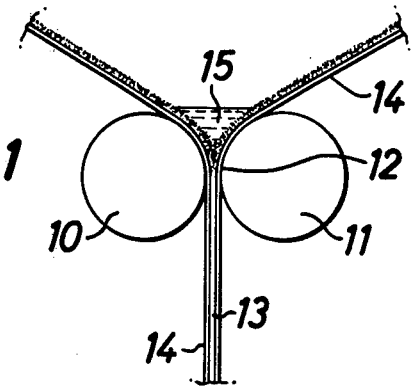
FIG. 1 is a simplified view of one embodiment of the present invention.

The apparatus comprises a pair of rollers 10 and 11 disposed to form a nip 12 therebetween. The rollers 10 and 11 are heated by heating means (not shown). A web having a sandwich construction comprising a layer of thermoplastic material 13 typically polyethylene and a pair of backing sheets of woven or non-woven material 14 is formed and is supplied to the nip 12 of the rollers 10 and 11. The web 14 is supplied upwardly to the rollers and at the nip web 14 is heated sufficiently to render the layer of thermoplastic material tacky. The backing sheets are separated to divide the thermoplastic layer therebetween and to form fibres in the surface thereof. A layer of liquid coolant 15 is disposed in the nip to effect cooling of the fibres during formation.

Figure 2:
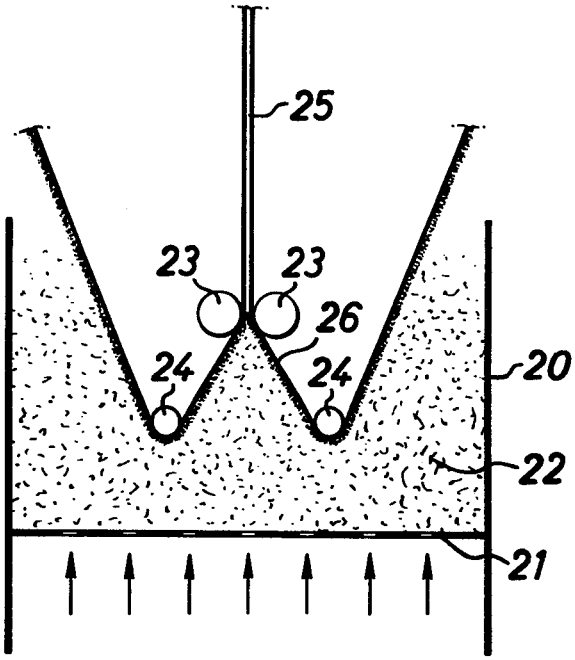
FIG. 2 is a view of an alternative embodiment of the apparatus in accordance with the present invention.

Turning now to the apparatus for forming the subject of FIG. 2 there is provided a fluidised gas chamber 20 having a grating 21 and a gas supply conduit for the supply of gas-typically air-to the underside of grating 21. Upwards of grating 21 there is provided a plurality of particles of solid coolant 22. The fluidised chamber 20 is provided with a pair of nip rollers 23 which are heated (by means not shown) and a pair of spaced guide rollers 24 disposed downwardly from the nip rollers 23. The axis of rotation of the guide rollers 24 are movable laterally and/or vertically. A web having the sandwich construction comprising a pair of spaced backing sheets 26 bonded together by means of an intermediate thermoplastic layer 25 is supplied downwardly to the nip rollers 23. The backing sheets 26 are separated after passing through the nip rollers and each backing sheet is passed around a guide roller 24 and then withdrawn from the fluidised gas chamber 20. The nip rollers 23 serve to heat the backing sheets and the thermoplastic material to a temperature such that the thermoplastic polymer is rendered sufficiently tacky to reduce the bond strength by at least 50% and the separation of the sheet materials 26 serves to draw the polymer into fibres extending from the surface thereof. The impingement of the gas stream and particulate material 22 serves to cool the fibres during formation to cause breakage of the same and to set the fibres relative to the surface of the sheet materials 26. At the same time solid particulate material is entrained by the fibres in the surface thereof to provide a solid filled fibre structure. The adjustment of the rollers 24 permits the angle of separation and the rate of drawing the fibres to be controlled by simple adjustment of the lateral spacing of the rollers 24 and their vertical separation from the plane containing the axis of rotation of nip rollers 23.

Figure 3:
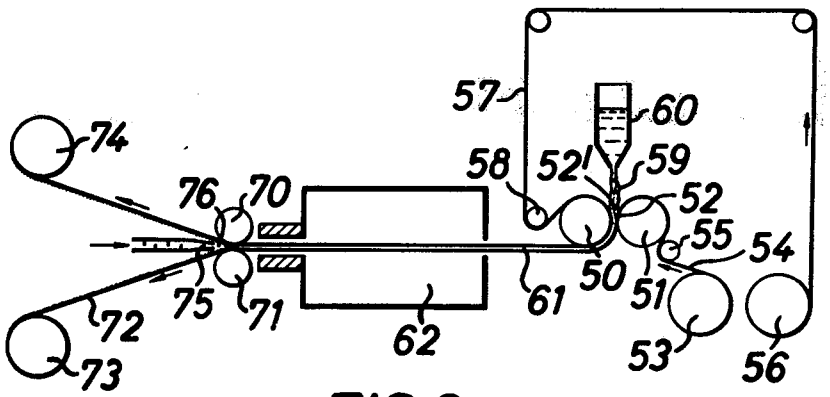
FIG. 3 is a view of a further embodiment of apparatus in accordance with the present invention.

In the apparatus of FIG. 3, a pair of rolls 50, 51 which together define a nip 52, are heated by means not shown. A supply reel 53 supplies a web 54 of backing material via idler 55 about the periphery of roll 51 to nip 52. A second supply reel 56 supplies a second web 57 via idler 58 to the periphery of roll 50 and thence to nip 52, so that the webs 54, 57 together define an open nip 52'. A stream or curtain of tack spinnable thermoplastic material 59 is introduced into nip 52' between the webs 54, 57 by means of an extruder or other suitable supply means shown generally at 60.

The heated rolls 50, 51 serve to band webs 54, 57 together to form a sandwich construction 61 and the thermoplastic is allowed to cool below the level at which it becomes tacky.

The cooled sandwich construction 61 is passed through a hot air chamber 62 to heat the thermoplastic which is then fed to a pair of heated rolls 70, 71 which heat the thermoplastic material at which it becomes tacky. The backing webs 54, 57 are then separated to divide the thermoplastic layer therebetween and to form fibres in the surface thereof and the resultant tack spun materials 72 is then fed to take up rollers 73, 74. A jet of cooling air 75 is directed to the nip 76 of rolls 70, 71 to effect cooling of the fibres during formation. The following examples illustrate specific embodiments in accordance with the present invention.

EXAMPLE 1

High density polyethylene having a melt index of 6 was applied to a woven fabric in the form of powder by transfer by an engraved roller to produce small dots of polyethylene arranged in a regular pattern. The polyethylene coated fabric was laminated to a second fabric by heating both to a temperature converting the polyethylene to a plastic or tacky state under slight pressure between rollers and the resulting laminate was subsequently cooled.

Thereafter the laminate was heated to a temperature of 50° to 60° C. above the melting point of the polyethylene to retakify the polyethylene. The fabric materials were separated while air was blown into the open angle, the air having a temperature of at least 30° C. less than the melting point of the polyethylene, the angle of separation was greater than 90°. The speed of the laminate passing the point of separation was within the range of 6 to 15 yards per minute.

The resultant material comprise a woven fabric carrying on its surface, a plurality of dots or areas of polyethylene drawn into fibres by the separation of the sheet materials.

EXAMPLE 2

Example 1 was repeated using a laminate formed by feeding a film of polyethylene into the angle formed by two converging sheets of fabric on both surfaces under conditions causing the polyethylene film interposed between the two fabrics to become tacky applying light pressure to the laminate to anchor the tackified polyethylene on the surface of both fabrics and thereafter separating the two fabrics while this polyethylene is still in the plastified and tacky state. The speed and the angle of separation were as set out in Example 1.

EXAMPLE 3

Example 1 was repeated using a heated metal roller to melt polyethylene arranged in the form of dots on the fabric, pulling the fabric from the heated rollers while the polyethylene was still tacky and thereafter applying a gaseous cooling agent to cause the fibres formed between the hot roller and the fabric to set while the strands are drawn to an increasing distance between the hot roller and the fabric.

EXAMPLE 4

Example 2 was repeated wherein the polyethylene was fed as a film onto the heated roller and one sheet of fabric was brought into contact with the tackified polyethylene on the roller and thereafter withdrawing the fabric from the roller and applying a gaseous cooling agent to cause the fibrous matter formed between the hot roller and the fabric to gel while the strands are still being drawn due to the increasing distance between the hot roller and the fabric.

EXAMPLE 5

Example 4 was repeated but the polyethylene was applied to the heating rollers by means of a knife arranged on the heated roller, the gap between the roller and the knife providing a film of molten polyethylene of substantially uniform thickness. The molten polyethylene was continuously fed into a trough formed by a knife as a front wall and two confining side walls on both sides positioned at a distance one inch smaller than the width of the fabric to be coated.

EXAMPLE 6

Example 1 was repeated using a polyamide terpolymer of nylon 6, nylon 66 and nylon 11 having a softening range of 123° to 128° C. and a melt index of 21. The polyamide terpolymer was applied to cellulosic non-woven fabric substrates to form a laminate. The laminate was separated in a manner described with Example 1 to produce a cellulosic fabric having a fibrous surface thereon suitable for use as a fusible interlining.

EXAMPLE 7

Example 5 was repeated, the polymer employed was a polyester polymer having a softening range of 123° to 128° C. and a melt index of 25.

EXAMPLE 8

A net-like structure comprising a copolymer of ethylene and vinyl acetate having a weight of 80 grams/square meter was fed into a calender together with two interfacing fabrics adapted to be turned into fusible interlinings for garments. The fabrics consisted of bulky rayon yarns in the filling and cotton warp yarns, and had a weight of 120 grams/square meter. The net was sandwiched between the two fabrics and the heated rollers of the calender were maintained at a temperature of 200° C. The softening range of ethylene vinyl acetate copolymer was within the range of 90° C. to 105° C. and heat was transmitted from the calender through the fabrics to the net, plastify to the extent that they serve as an adhesive fusing the two fabrics locally together. The sandwich thus produced was at a later stage reheated to a temperature such that the ethylene/vinyl acetate polymer became tacky and the two fabrics were separated at this stage and air was blown through the fabric to gel the fibrous polymer mass extruded between the diverging sheets of fabrics. In this case, coolant was passed through the backing sheet to cool the fibres of the formation.

EXAMPLE 9

Example 8 was repeated but the fusible material was in the form of ethylene/vinyl acetate film having a thickness of 80 microns, the film being tackified by means of infra-red radiation. During separation of the two fabrics with the ethylene/vinyl acetate being tackified by heat, the cooling was effected by means of a fluidised bed comprised of solid particles maintained in suspension by a current of air strong enough to counterbalance the weight of the particles. The cooling was effected by means of the solid particulate matter and the air itself.

The heating was carried out by feeding the sandwich constructions downwardly to a pair of nip rollers which were heated to tackify the ethylene/vinyl acetate polymer and then separating two sheets to pass each over a guide roller in the general manner shown in FIG. 2, to expose the diverging polymer layers to the fluidised bed.

EXAMPLE 10

The procedure described in Example 9 was repeated with the fluidised bed comprising tiny particles of activated carbon. When impinging upon the molten fibrous mass of polymer strand, the particles of activated carbon adhere to the fibrous coating and remain on both coated fabrics after separation, thus forming a layer of activated carbon where each pellet was retained by the strands of the polymer then only a small percentage of the total surface area of each particle is blocked at the point of contact with the fusible strand of polymer itself.

EXAMPLE 11

Example 10 was repeated and instead of using a fluidised bed, a jet of air containing particulate activated carbon was blown into the opening between the diverging fabrics to set the strands of polymer formed between the diverging sheets materials to implant the activated carbon in the material itself.

The resultant material contained a fibrous layer including a large number of particles of activated carbon having a large and effective surface area thus an extremely absorbent surface.

EXAMPLE 12

Example 9 was repeated, but with engraved calender rolls serving to tackify the ethylene/vinyl cetate layer between the backing fabrics thus bonding the sheets together only where the raised portions of the heated calender rolls had pressed. Separation was carried out in the manner described in Example 9 and the fibrous coating thus produced showed the pattern of the engraved calender rolls.

I claim:

1. A method for the formation of a fusible sheet material comprising the steps of:

forming a laminate of two backing sheets with a layer of thermoplastic material sandwiched therebetween, said thermoplastic material of the type capable of being rendered tacky reversibly and serving to bond said backing sheets together;

determining an amount of heat to raise said laminate to an elevated temperature at which it is observed the bonding strength between said backing sheets is decreasec by at least 50% and said thermoplastic material layer assumes a tacky condition;

heating said laminate to said determined elevated temperature at which the bonding strength between said backing sheets is decreased by at least 50% and said thermoplastic material layer assumes a tacky condition;

separating said backing sheets while maintaining said thermoplastic material layer at said elevated temperature whereby a portion of said thermoplastic material layer adheres to each of said backing sheets;

applying a cooling agent to the fibrous filaments formed on the surface of the portion of the thermoplastic material layer adhering to each of said backing sheets after said separating step; and selecting an angle of separation, degree of cooling and rate of separation for said backing sheets such that the average solidifying length of the fibrous structures formed by the tackified thermoplastic material between the diverging sheets is substantially twice the average length of the fibrous structure on the individual backing sheets.

2. A method as claimed in claim 1 characterised in that an intermediate laminate of sandwich construction is formed by said forming step and wherein the sandwich construction is heated by said heating step such that the thermoplastic material loses substantially all structural stress features as discernible through a microscope in polarised light between crossed nicols.

3. A method in accordance with claim 1 including the step of cooling said laminate formed during said forming step and wherein said heating step is carried out by reheating said laminate after said cooling step.

4. A method in accordance with claim 1 including the step of directing a supply of particles of activated carbon onto the fibrous filaments formed on said portions of said thermoplastic material layer prior to solidification of said thermoplastic material whereby said activated carbon particles adhere thereto.

5. Apparatus for the tack spinning of materials comprising, in combination, a pair of rolls defining a nip, means for supplying a backing sheet to each roll to bring said backing sheets together at the nip of said rolls, means for supplying a tack spinnable thermoplastic material to said nip to form a layer of thermoplastic material between said backing sheets in a sandwich construction, first means for heating said thermoplastic material at said nip, means for cooling said thermoplastic material to form a bond between said backing sheets, means determining an amount of reheating said thermoplastic material layer sufficiently to render said thermoplastic material in a tacky condition, second heating means in response to said determining means for reheating said thermoplastic material layer sufficiently to render said thermoplastic into said tacky condition, means for progressively separating said backing sheets while maintaining said thermoplastic material in said tacky condition to draw fibers from the surface of the portions of said thermoplastic material layer on each of said sheets, and means for directing a stream of cooling agent onto the fibers on said surface of each portion of said thermoplastic material layer to set the same.

6. A method for the formation of a fusable sheet material comprising the steps of:

forming a laminate of two backing sheets with a layer of thermoplastic material sandwiched therebetween, said thermoplastic material being of the type capable of being rendered tacky reversibly and serving to bond said backing sheets together;

determining an amount of heating to raise said laminate to an elevated temperature at which the thermoplastic material is observed to lose substantially all structural stress features as discernible through a microscope in polarized light between crossed nicols, whereby said thermoplastic material assumes a tacky condition;

heating said laminate to said elevated temperature at which the thermoplastic material loses substantially all structural stress features as discernible through said microscope in polarized light between crossed nicols, whereby said thermoplastic material assumes said tacky condition;

separating said backing sheets while maintaining said thermoplastic material layer at said elevated temperature whereby a portion of said thermoplastic material layer adheres to each of said backing sheets;

applying a chemically inert cooling agent to the fibrous filaments formed on the surface of the portion of the thermoplastic material layer adhering to each of said backing sheets after said separating step, said cooling agent leaving no accretions on said filaments after cooling; and selecting an angle of separation, degree of cooling and rate of separation for said backing sheets such that the average solidifying strength of the fibrous structures formed by the tackified thermoplastic material between the diverging sheets is substantially twice the average length of the fibrous structure on the individual backing sheets.

7. A method as claimed in claim 6 characterized in that an intermediate laminate of sandwich construction is formed by said forming step.

8. A method according to claim 6 including the step of cooling said laminate formed during said forming step, and wherein said heating step is carried out by reheating said laminate after said cooling step.

* * * * *